US005473991A

United States Patent [19]

Crum

[11] Patent Number: 5,473,991

[45] Date of Patent: Dec. 12, 1995

[54] APPARATUS FOR CONVEYING WORK OBJECTS

[76] Inventor: Martin D. Crum, 17282 Avenue 324, Visalia, Calif. 93292

[21] Appl. No.: 94,695

[22] Filed: Jul. 22, 1993

[51] Int. Cl.[6] ..... B65G 17/00

[52] U.S. Cl. ..... 104/172.3; 104/172.2; 104/88.01; 104/242

[58] Field of Search ..... 104/172.3, 172.2, 104/172.1, 88.01, 242; 186/58, 62, 2, 26, 27, 34; 280/33.991

[56] References Cited

U.S. PATENT DOCUMENTS

| | | | |
|---|---|---|---|
| 783,070 | 2/1905 | Patterson | 104/172.3 |
| 1,740,014 | 12/1929 | Hawkins . | |
| 2,132,455 | 10/1938 | Bishop . | |
| 2,604,190 | 7/1952 | Meyer | 186/62 |
| 2,633,253 | 3/1953 | Martin | 186/62 |
| 2,660,127 | 11/1953 | Boyko et al. . | |
| 2,844,241 | 7/1958 | King | 104/172.3 |
| 3,048,126 | 8/1962 | Salapatas . | |
| 3,055,313 | 9/1962 | Stoll et al. | 104/172.3 |
| 3,064,587 | 11/1962 | O'Neal et al. . | |
| 3,077,164 | 2/1963 | Da Roza et al. | 104/172.2 |
| 3,127,849 | 4/1972 | Klamp . | |
| 3,186,355 | 6/1965 | Stoll et al. | 104/172.3 |
| 3,655,013 | 4/1972 | Weller . | |
| 3,749,027 | 7/1973 | Adler et al. . | |
| 3,874,302 | 4/1975 | Crosswhite | 104/172.3 |
| 3,910,198 | 10/1975 | Krivec . | |
| 4,801,003 | 1/1989 | Costa | 104/172.1 |
| 5,096,049 | 3/1992 | Anderson | 104/172.3 |

FOREIGN PATENT DOCUMENTS

| | | | |
|---|---|---|---|
| 0428994 | 10/1974 | U.S.S.R. | 104/172.3 |

*Primary Examiner*—Mark T. Le
*Attorney, Agent, or Firm*—Worrel & Worrel

[57] ABSTRACT

An apparatus for conveying work objects having a conveyor for moving the work objects in a predetermined direction of travel to a terminus; linking assemblies for individually releasably interconnecting the work objects and the conveyor for movement of the work objects in the direction of travel; and a collection area adjacent to the terminus for receiving the work objects.

2 Claims, 4 Drawing Sheets

APPARATUS FOR CONVEYING WORK OBJECTS

BACKGROUND OF THE INVENTION

1. Field of the Invention

The present invention relates to an apparatus for conveying work objects and, more specifically, to such an apparatus which is particularly well suited to the return of shopping carts after use.

2. Description of the Prior Art

The maintenance of control over work objects which are individually used to preform designated tasks, but which, once used, are adapted for reuse and, for that purpose, must be returned to a central location, presents unique difficulties.

For example, the problems associated with the use of shopping carts by customers in shopping complexes constitutes a more or less constant aggravation to both the owners and operators of the shopping complexes as well as to the customers. With the advent of expansive shopping complexes, such as malls and large volume retail stores, the availability of shopping carts for customers is a commercial necessity. However, the natural consequence of supplying such shopping carts for customers' usage produces a more or less continuous stream of shopping carts into the parking areas surrounding the shopping complex, without a dependable means by which the shopping carts can be returned for reuse. Store personnel must periodically collect and return the shopping carts to a central collection area for reuse. This manual return of shopping carts is rarely adequate due to the unavailability of personnel for such duties and to those personnel assigned the task being assigned other duties requiting their attention. For all of these reasons, the frequency with which the shopping carts are collected is, as a practical matter, entirely inadequate for the purpose.

With or without a conscientious effort, using conventional means, to return the shopping carts to a central collection area, chronic problems persist. Since customers are disinclined to return shopping carts to the central collection area, they are commonly simply abandoned after usage. The unattended shopping carts thereby become nuances, as well as hazards, to both vehicles and pedestrians. They can roll into parked vehicles, obstruct parking stalls and traffic lanes and may be taken for usage off the premises, either temporarily or with the intent of permanent conversion.

For a multitude of reasons, the necessity for providing shopping carts constitutes a cost of doing business which is excessive, as well as a continual annoyance both to retail operators and customers. The shopping carts are themselves expensive to purchase and to replace. The cost of employing personnel to recover the shopping carts on a periodic basis is significant. The liability associated with damage caused by the shopping carts inflates insurance premiums. Finally, the scattered disposition of the shopping carts throughout a shopping complex constitutes a blight which detracts from the aesthetic appeal of the shopping complex thereby adversely affecting the commercial appeal of the entire complex.

While prior art efforts have been directed to alleviating all of the problems associated therewith, these efforts have been largely unsuccessful. It is known, for example, to employ subcollection areas at designated locations in the parking lots to which the shopping carts can more conveniently be returned and from which the shopping carts can more efficiently be returned to the main collection area. However, in practice, few customers return the shopping carts to the subcollection areas. Thus, the aforementioned problems remain. A variety of other systems have been employed to encourage the return of shopping carts to the main collection area with little or no success.

Therefore, it has long been known that it would be desirable to have an apparatus for conveying work objects which is uniquely well suited to the conveyance of shopping carts from the outlying areas of parking lots to locations adjacent to shopping complexes; which is so designed as to encourage the return of shopping carts to the central collection area; which is entirely safe and dependable in operation; which is inconspicuous so as not to detract from the overall aesthetic appearance of the shopping complex; which can be installed in a variety of embodiments and in a variety of environments to achieve the return of the shopping carts; which is inexpensive to install, maintain and operate and requires no personnel for operation thereof; and which is otherwise entirely successful in achieving its operational objectives.

SUMMARY OF THE INVENTION

Therefore, it is an object of the present invention to provide an improved apparatus for conveying work objects.

Another object is to provide such an apparatus which is particularly well suited to achieving the return of shopping carts from the outlying areas of parking lots to collection areas adjoining shopping complexes.

Another object is to provide an apparatus which affords the ability to provide customers with the means for conveyance of their purchases to their respective vehicles while ensuring that the shopping carts are made available for use by other customers at the earliest possible opportunity at a minimum cost.

Another object is to provide such an apparatus which can be operated substantially without supervision and without the presence of personnel, while encouraging full utilization by customers.

Another object is to provide such an apparatus which can readily be installed and operated in virtually any environment in a variety of embodiments specifically adapted to the environment of use.

Another object is to provide such an apparatus which can be installed in existing shopping areas using existing shopping carts readily, inexpensively and dependably to achieve its operational objectives.

Another object is to provide such an apparatus which employs subassemblies which do not interfere with usage either of the shopping carts or of the parking areas.

Another object is to provide such an apparatus which can operate dependably and compatibly with existing facilities almost entirely without supervision or other attention by personnel.

Further objects and advantages are to provide improved elements and arrangements thereof in an apparatus for the purpose described which is dependable, economical, durable and fully effective in accomplishing its intended purpose.

These and other objects and advantages are achieved, in the preferred embodiment of the present invention, in an apparatus for conveying work objects having a conveyor for moving the work objects in a predetermined direction of travel to a terminus; linking assemblies for individually, releasably interconnecting the work objects and the conveyor for movement of the work objects in the direction of travel; and a collection area adjacent to the terminus for receiving the work objects.

DESCRIPTION OF THE PREFERRED EMBODIMENTS

Figure 1:
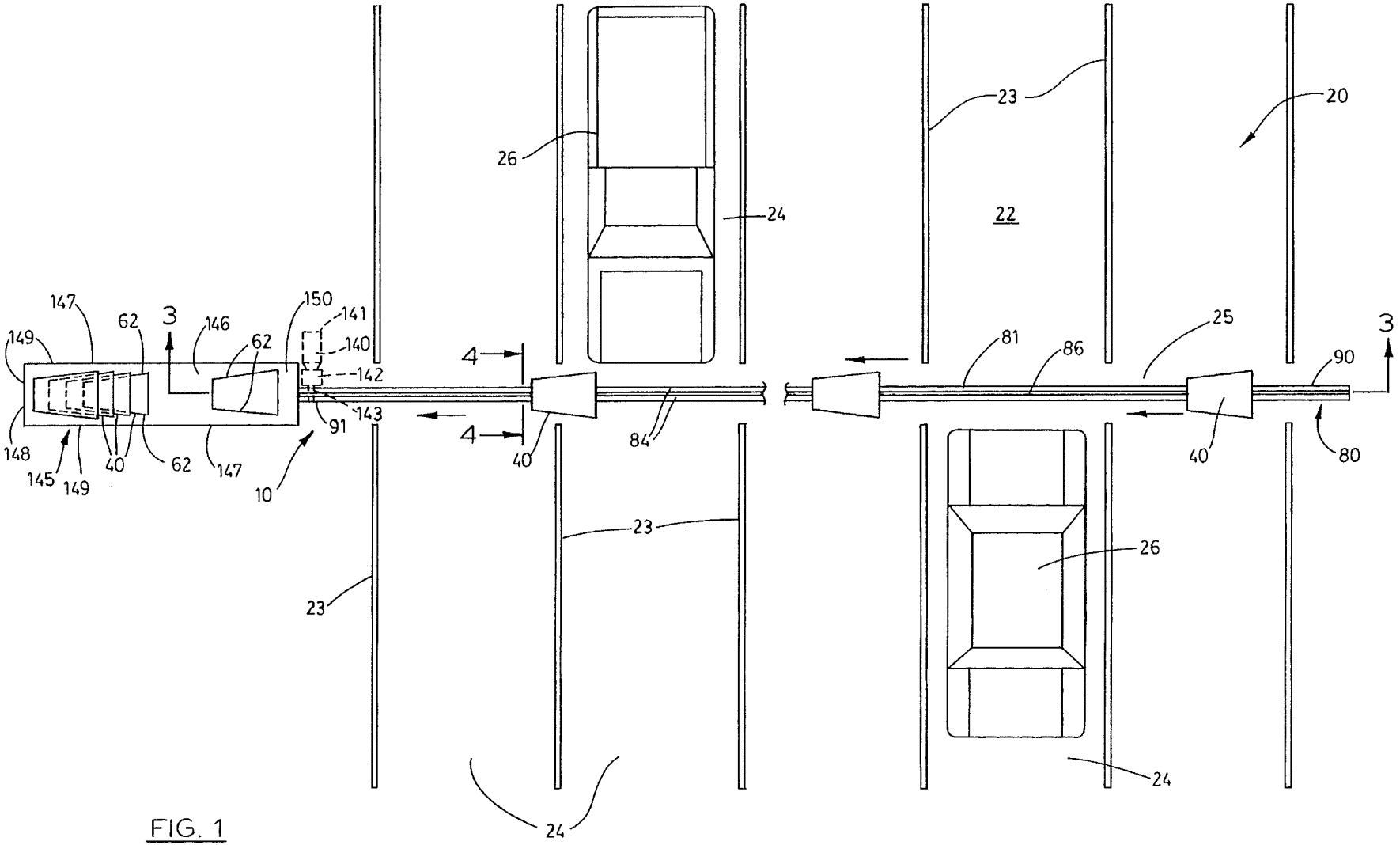
FIG. 1 is a fragmentary, top plan view of a representative parking lot, such as adjacent to a shopping complex, showing a first embodiment of the apparatus of the present invention.

Referring more particularly to the drawings, the conveying system or apparatus of the present invention is generally indicated by the numeral 10 in FIG. 1. As shown therein, the apparatus is depicted in a typical operative environment installed on a parking lot 20, such as adjacent to a shopping complex, not shown. The parking lot, in the conventional manner, is constructed of asphalt paving, concrete, or other hardened implacement 21 covering the earth so as to provide a flat upper surface 22 serving as the parking lot. In the conventional manner, the parking lot bears painted stripes 23 defining a plurality of parking stalls 24. As shown in FIG. 1, the parking stalls are so arranged as to be deployed in pairs of juxtaposed parking stalls separated by a median 25 preferably extending in the direction of the shopping complex, not shown. Representative automotive vehicles 26 are shown parked in two of the parking stalls.

Figure 2:
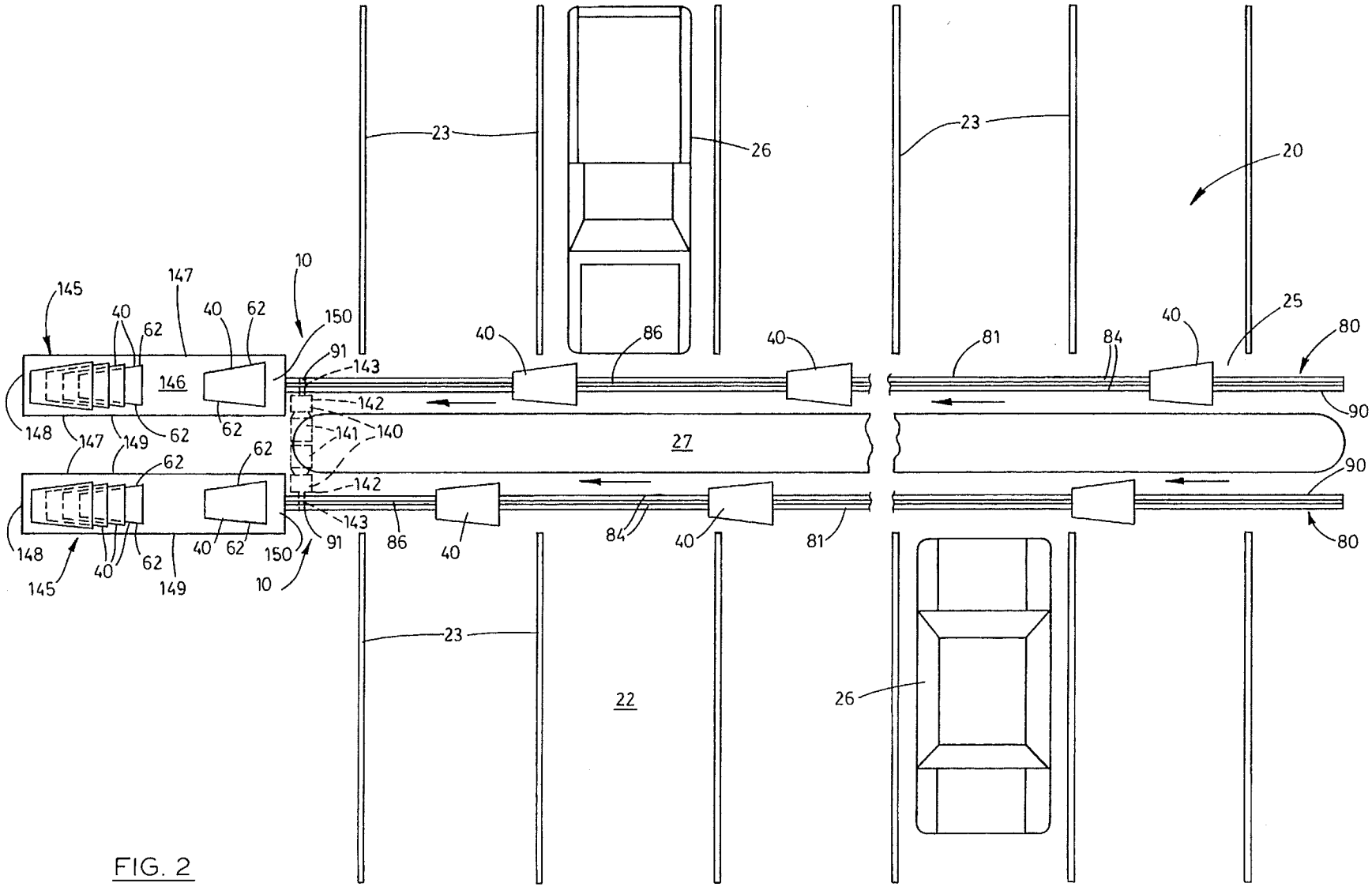
FIG. 2 is a fragmentary top plan view of a representative parking lot, such as adjacent to a shopping complex, showing another environment of use of the apparatus of the present invention.

FIG. 2 depicts a similar operational environment for the apparatus 10. More specifically, a pair of the apparatuses 10 is shown disposed in adjacent spaced relation to each other on opposite sides of a concrete island 27. The arrangement depicted in FIG. 2 is provided merely to illustrate another specific environment in which the apparatus 10 can be employed.

In the illustrative embodiment, the apparatus 10 is employed for use in returning shopping carts 40 from the parking lot 20 to a central collection area for reuse. Each of the shopping carts has a main frame 41 including a pair of horizontal frame members 42 interconnected by a front horizontal frame member 43 extending therebetween. A pair of front wheel assemblies 44, individually pivotal about vertical axes, are individually mounted on the horizontal frame members 42. Similarly, a pair of rear wheel assemblies 45, individually pivotal about vertical axes, are individually mounted on the horizontal frame members individually in trailing relation to the front wheel assemblies 44. The wheel assemblies of each pair are transversely spaced predetermined distances from each other as can be visualized upon reference to FIGS. 4 and 7.

Each of the shopping carts 40 has a basket support frame 50 extending upwardly from the horizontal frame members 42. A basket support frame includes lateral frame members 51 interconnected at their forwardly extending ends by a transverse frame member 52. Upright frame members individually interconnect the horizontal frame members 42 and their respective lateral frame members 51.

Figure 3:
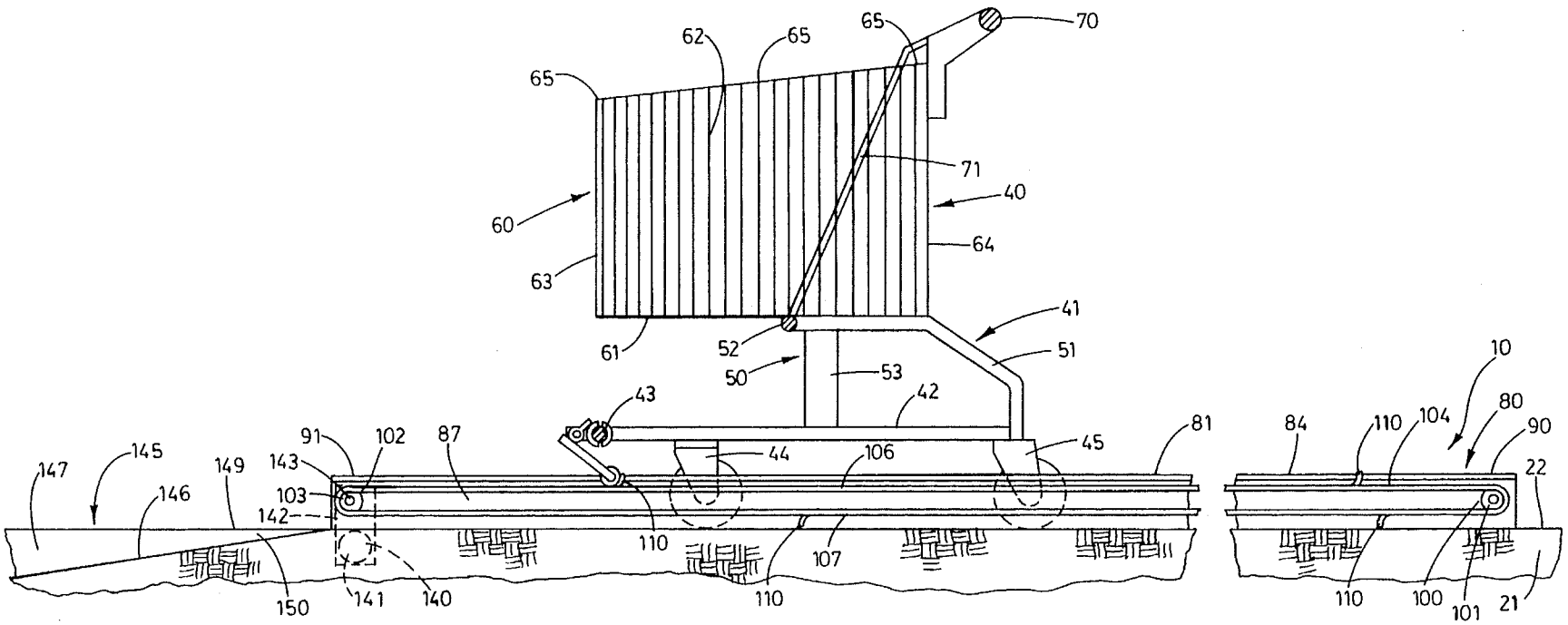
FIG. 3 is a somewhat enlarged, fragmentary longitudinal vertical section taken from a position indicated by line 3—3 in FIG. 1.

A basket assembly 60 is mounted on the basket support frame 50 of each shopping cart 40. The basket assembly includes a bottom wall 61. A pair of side walls 62 are mounted on the bottom wall at its lateral margins and extend upwardly therefrom. The side walls 62 converge in a direction from right to left as view in FIG. 3 or, in other words, in the direction of the normal forward direction of travel of the shopping cart. The forwardly extending ends of the side walls are interconnected by a flat front wall 63. The basket assembly has a rear wall 64. The bottom wall, converging side walls, front wall and rear wall have upper edges 65. The walls of the basket assembly are of a wire or cage like construction. The rear wall is pivotal about the upper edge thereof in a clockwise direction as shown in FIG. 3.

A handle assembly 70 is mounted on the basket assembly 60 adjacent to the upper edge 65 of the rear wall 64. A pair of laterally spaced braces 71 interconnect the basket assembly and the handle assembly so as to provide additional support therefore.

The apparatus 10 of the present invention can be constructed in a variety of embodiments. The preferred embodiments are shown and described herein. However, the apparatus can also be constructed in embodiments in which the apparatus is flush with the upper surface 22, or recessed therewithin.

Figure 4:
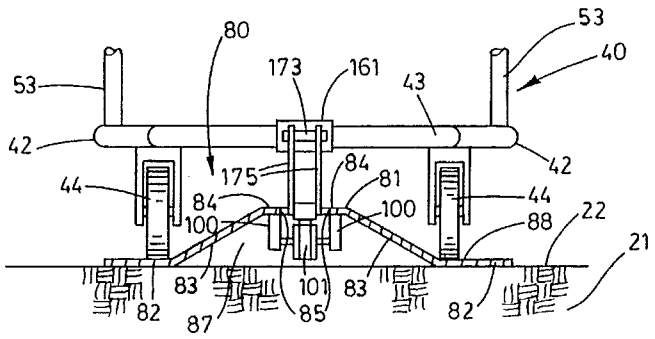
FIG. 4 is a fragmentary transverse vertical section taken from a position indicated by line 4—4 in FIG. 1.

The first embodiment of the apparatus of the present invention is shown in FIGS. 1, 2, 3, 4, 5 and 6. The apparatus has a conveyor assembly generally indicated at 80. The conveyor assembly includes a conveyor housing 81 preferably constructed of steel or another suitable material. Referring more particularly to FIG. 4, the conveyor housing has a pair of side plates 82 which are mounted in facing engagement with the flat upper surface 22 of the hardened implacement 21 of the parking lot 20. The side plates can be bolted or otherwise secured in the position described. The conveyor housing has a pair of sloped shoulder plates 83 individually extending upwardly from the respective side plates 82 and sloped toward each other. A pair of horizontal upper plates 84 are mounted on the sloped shoulder plates defining a horizontal plane parallel to the upper surface 22. The upper plates have juxtaposed parallel edges 85 defining an opening, or slot, 86 therebetween communicating with an interior 87 of the conveyor housing defined by the conveyor housing 81 and the upper surface 22. The slot extends the entire length of the conveyor housing.

The upper surfaces of the side plates 82 define a platform 88 for the shopping carts 40, as will hereinafter be described in greater detail. The platform defined by the side plates is of a gauge, or width, corresponding to the transverse spacing of the front wheel assemblies 44 and rear wheel assemblies 45 of the shopping carts, as can best be seen in FIG. 4.

The conveyor assembly 80, as shown in FIG. 1, extends along the median 25 between adjoining pairs of parking stalls 24 from an outer end portion 90 to a terminus, or inner end portion, 91. It will be understood that the inner end portion is preferably adjacent to the shopping complex, not shown. The outer end portion can be any desired distance from the shopping complex, but is preferably located at a remote portion of the parking lot. The arrangement shown in FIG. 2 is intended only as another representative depiction of a typical arrangement. In this instance, a pair of the conveyor assemblies 80 are disposed on opposite sides of a concrete island 27 within the median 25. It will be understood that a variety of other arrangements can be employed in accordance with the preferences of the people involved. In fact, if desired, the conveyor assembly can be of a curved configuration.

Figure 6:
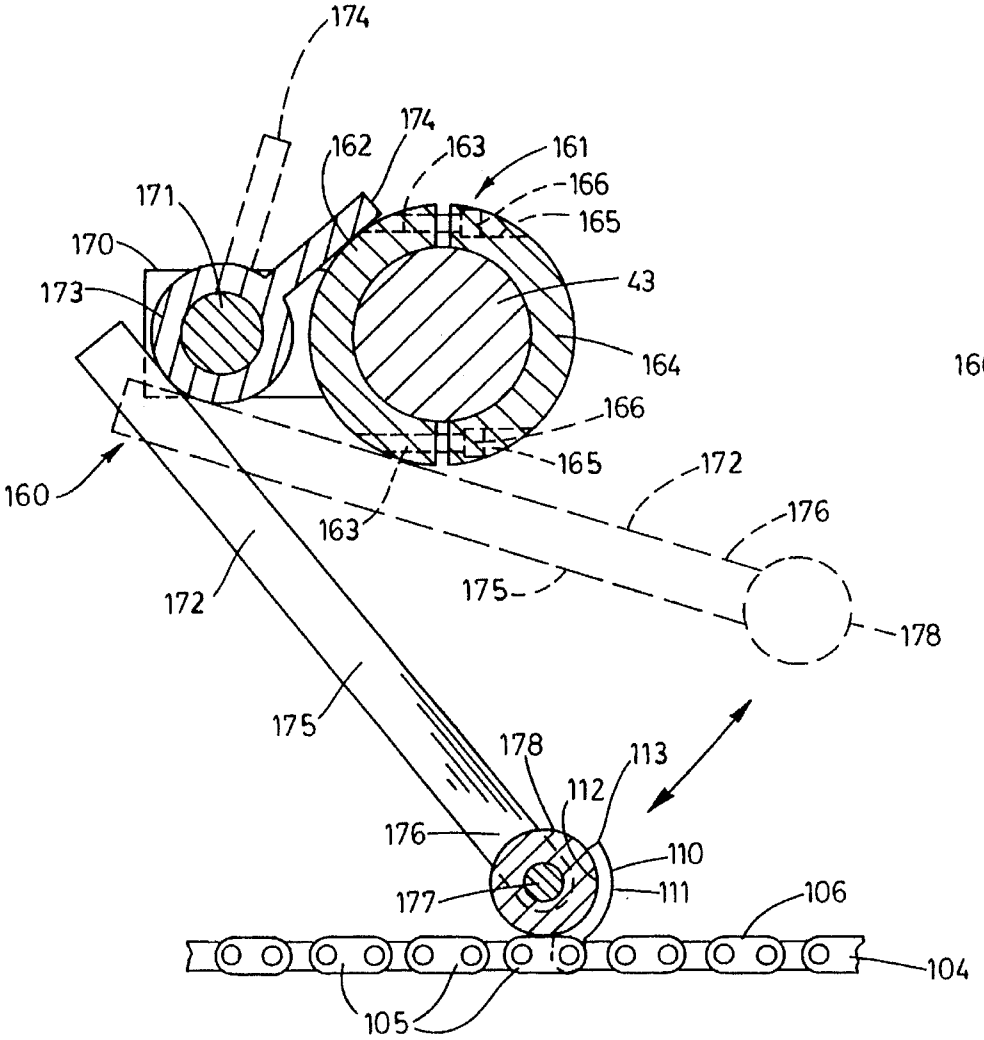
FIG. 6 is a still further enlarged, transverse vertical section taken from a position indicated by line 6—6 in FIG. 5 and showing a pivot arm assembly thereof in full lines in a transport position and in phantom lines in a retracted position pivoted therefrom.

As shown in FIG. 3, the conveyor assembly 80 mounts a pair of outer sprocket mounting plates 100 individually on the upper plates 84, within the interior 87 of the conveyor housing extending downwardly therefrom in parallel relation on opposite sides of the slot 86. An outer sprocket assembly 101 is mounted on and extends between the outer sprocket mounting plates for rotation in a vertical plane in alignment with the slot 86. Similarly, a pair of inner sprocket mounting plates 103 are mounted on the upper plates 84 of the conveyor housing at the inner end portion 91 thereof extending downwardly from the upper plates in parallel relation on opposite sides of the slot 86. An inner sprocket assembly 103 is mounted for rotational movement on and extending between the inner sprocket mounting plates 102 in alignment with the slot 86. A conveyor chain 104 is entrained about the outer sprocket assembly and inner sprocket assembly so as to extend therebetween. The conveyor chain is composed of a plurality of links 105, as shown in FIGS. 6, and has an upper run 106 and a lower run 107.

A plurality of drive fingers 110 are mounted in fixed position on selected links 105 of the conveyor chain 104 in spaced relation to each other. The drive fingers are disposed in spaced relation on the conveyor chain and oriented so as to extend generally upwardly from the upper run 106 and, accordingly, downwardly from the lower run 107, as can best been seen in FIG. 6. Each of the drive fingers has a convex surface 111 and an opposite concave surface 112. Each drive finger extends outwardly to an outer edge 113. The convex surface 111 is deployed so as to face in the direction of travel, as will hereinafter be described in greater detail.

Figure 7:
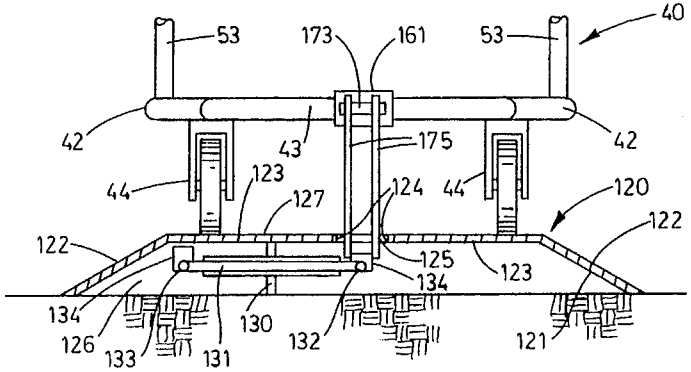
FIG. 7 is a fragmentary, transverse vertical section of the apparatus of the present invention taken from a position equivalent to that shown in FIG. 4, but showing a second embodiment thereof.

A second embodiment of the conveyor assembly of the present invention is generally indicated by the numeral 120 and is shown in FIG. 7. The conveyor assembly 120 has a conveyor housing 121 also preferably constructed of steel or another suitable material. Referring more particularly to FIG. 7, the conveyor housing has sloped side plates 122 which are individually mounted, such as by bolts, not shown, on the upper surface 22 of the hardened implacement 21 of the parking lot 20. The conveyor housing has horizontal upper plates 123 extending toward each other and defining a horizontal plane parallel to the upper surface 22. The upper plates extend toward each other to parallel edges 124 bounding and opening, or slot, 125 of the conveyor housing. The conveyor housing encloses an interior 126 bounded by the conveyor housing and the upper surface 22. In the case of conveyor assembly 120, the horizontal upper plates define the platform 127 which is of a gauge, or width, greater than the width of the pairs of wheel assemblies, that is the front wheel assemblies 44 and the wheel assemblies of the rear wheel assemblies 45. It will further be understood that the conveyor assembly 120 extends between an outer end portion at a suitable location in the parking lot and an inner end portion in proximity to the shopping complex.

The conveyor assembly 120 mounts a pair of pulley assemblies 130 mounted for rotation about substantially vertical axes within the interior 126 of the conveyor housing 121 and at opposite ends of the slot 125. A cable 131 is entrained about the pulley assemblies for movement therewith and has an inner run 132 in alignment with the slot 125 and an outer run 133. Drive fingers 134 of the same construction and orientation as the drive fingers 110 of the conveyor assembly 80 are mounted on the cable 131 in spaced relation to each other and with the concave surfaces thereof disposed for movement in a direction of travel with the inner run 132 of the cable from the outer end portion of the conveyor assembly to the inner end portion thereof.

The conveyor assembly 80 includes a conveyor drive assembly 140 preferably mounted in a suitable implacement adjacent to the inner end portion 91 of the conveyor assembly as shown in FIG. 1. The drive motor 141 is connected to a source of electrical energy, not shown. The drive motor is mounted in driving relation to a gear box 142 which, in turn, is connected through a drive linkage 143 in driving relation to the inner sprocket assembly 103 operable to move the upper run 106 of the conveyor chain 104 from right to left as viewed in FIG. 3. It will be understood that a similar drive assembly is employed in respect to the arrangement shown in FIG. 2 and for the conveyor assembly 120 shown in FIG. 7.

The apparatus 10 includes a cart receiving housing, or collection area, 145. The receiving housing can be constructed in a variety of different forms, but preferably is formed within the hardened implacement 21 of the parking lot 20 as a recessed area therewithin. Thus, the housing has a sloped floor 146 sloping from the terminus 91 of the conveyor assembly extending downwardly therefrom on a sloped angle from right to left as viewed in FIG. 3. The cart receiving housing has a pair of parallel side walls 147 which are disposed in vertical relation parallel to each other and spaced from each other preferably a distance only relatively slightly greater than the width of the shopping carts 40, as illustrated in FIGS. 1 and 2. The cart receiving housing has a vertical end wall 148. The side walls and end wall have upper edges 149 which are, in the preferred embodiment, in substantially the same plane as the upper surface 22. Thus, the upper edges of the sloped floor on the right as viewed in FIG. 3, and of the side walls 147 define an entrance opening 150 to the cart receiving housing 145. Any suitable means, not shown, can be provided for removing the shopping carts from the collection area.

Figure 5:
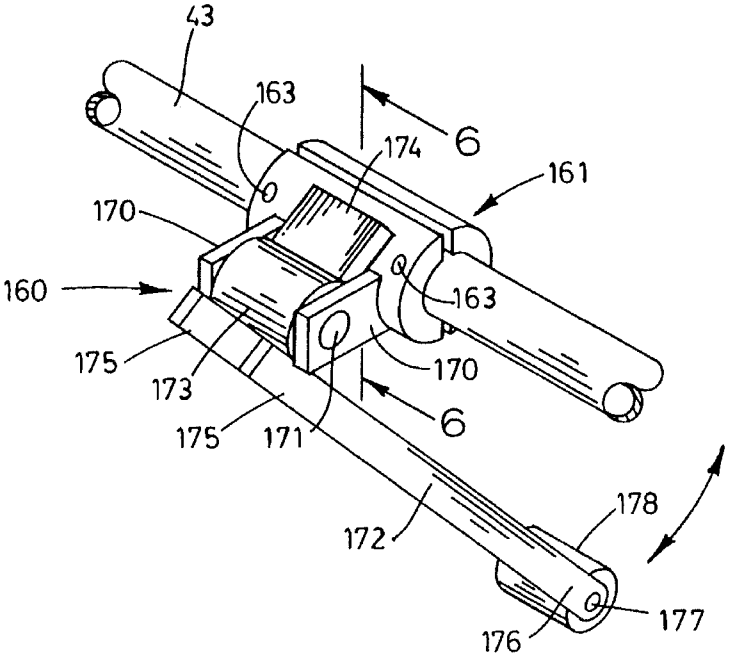
FIG. 5 is a somewhat further enlarged, fragmentary perspective view of a linking assembly of the apparatus of the present invention.

Each of the shopping carts 40 mounts a linking assembly 160 shown best in FIGS. 5 and 6. The linking assembly includes a clamp assembly 161 composed of a forward clamp member 162 having four internally screw threaded holes 163. The clamp assembly includes a rearward clamp member 164 having four smooth holes 165 extending therethrough in positions corresponding to those of the internally screw threaded holes of the forward clamp member. The clamp assembly is secured in position on the front horizontal frame member 43 of the main frame 41 of the shopping cart with bolts 166 individually extending through the smooth holes 165 of the rearward clamp member and screw-threadably secured in the internally screw threaded holes 163 of the forward clamp member to clamp the front horizontal frame member therebetween. The clamp assembly is mounted as described substantially centrally of the front horizontal frame member 43 as best shown in FIGS. 4 and 7.

The linking assembly mounts a pair of parallel mounting plates 170 on the forward clamp member 162 extending outwardly therefrom. A cylindrical shaft 171 is mounted on and extends between the mounting plates parallel to the front horizontal frame member 43. A pivot arm assembly 172 is pivotally mounted on the cylindrical shaft 171. The pivot arm assembly includes a pivot sleeve 173 mounted for pivotal movement about the cylindrical shaft 171. A stop plate 174 is mounted on the pivot sleeve 173 in a predetermined position disposed for engagement with the forward clamp member 160, as shown in FIGS. 5 and 6. A pair of parallel arms 175 are mounted on the pivot sleeve on the opposite side thereof from the stop plate 174 and extending tangentially thereto downwardly to distal end portions 176. A cylindrical shaft 177 is mounted on and extends between the distal end portions 176 of the parallel arms parallel to the cylindrical shaft 171. A roller 178 is rotationally received about the cylindrical shaft 177.

Referring more particularly to FIG. 6, the pivot arm assembly 172 is thus mounted for pivotal movement between the position shown in full lines in FIG. 6 and the position shown in phantom lines therein.

OPERATION

The operation of the described embodiment of the subject invention is believed to be clearly apparent and is briefly summarized at this point.

In all of the various forms of the invention, the method of operation is substantially the same. The conveyor drive assembly 140 is operated continuously, at least during normal business hours. More specifically, the drive motor 141 is operated to transport the upper run 106 of the conveyor assembly 80 and the corresponding inner run 132 of the conveyor assembly 120 from right to left as viewed in FIG. 3 relative to the conveyor assembly 80. This causes the drive fingers 110 of conveyor assembly 80 and the drive fingers 134 of conveyor assembly 120 to move in the same direction from right to left as viewed in FIG. 3. In the case of conveyor assembly 80 shown in FIGS. 1, 2, 3 and 4, the drive fingers are moved with the upper run of the conveyor assembly within the slot 86. In the case of conveyor assembly 120, the drive fingers 134 are moved in the same direction immediately beneath the slot 125. Except as herein noted, the operative effect thereof is substantially the same. In any case, the operation of the conveyor assemblies is substantially invisible from externally of the conveyor housings 81 and 121.

Accordingly, customers patronizing the shopping complex employ the shopping carts 40 in the conventional fashion using them to transport the purchased items from the store to their respective vehicles 26. They unload their purchases from the basket assembly 60 thereof into the vehicles. When this has been achieved and they are ready to give up control of the shopping cart, the apparatus 10 of the present invention comes into play.

For illustrative convenience, if it is assumed that a customer has loaded purchased items from the shopping cart 40 into the vehicle 26 in the upper left as viewed in FIG. 1, the customer can move the shopping cart directly to the conveyor assembly 80 or, in other words, toward the median 25 immediately adjacent to the parking stall 24 in which the customer's vehicle 26 is parked. Referring more particularly to FIG. 4, the customer simply moves the front wheel assemblies 44 of the shopping cart 40 up the adjacent sloped shoulder plate 83 of the conveyor housing 81 turning the shopping cart gradually into the orientation in which the front wall 63 of the basket assembly 60 faces the cart receiving housing 145, or in other words, the shopping complex. In doing so, the front wheel assembly on the right as viewed in FIG. 4 passes over the upper plates 84 and the slot 86 thereof and down the opposite shoulder plate 83 so that the wheel assemblies individually come into engagement with the platforms 88 with the remainder of the conveyor housing 81 disposed therebetween, as shown in FIG. 4. During such movement, the pivot arm assembly 172 borne by the roller 178 passes over the conveyor housing by virtue of its roller 178 riding along any surfaces thereof. However, once the shopping cart is oriented to the position shown in FIG. 4, the roller and the arms 175 thereof pass gravitationally through the slot 86 of the conveyor housing 81 to the position shown in full lines in FIG. 6.

At this point, the customer can simply abandon the shopping cart in the position described and leave the parking lot 20 in the customer's vehicle 26. The shopping cart during this period of time simply remains in the position described until the next successive drive finger 110 borne by the upper run 106 of the conveyor assembly 80 moves into contact with the roller 178, as can best be visualized in FIG. 6. When this occurs, the drive finger, or more specifically the concave surface 112 thereof engages the trailing surface of the roller as shown in FIG. 6 and the pivot arm assembly is moved fully into the position shown in FIG. 6 in full lines. This causes the stop plate 174 to engage the external surface of the forward clamp member 162 as shown in full lines in FIG. 6 so that the movement from right to left as viewed in FIG. 6 is immediately transferred through the stop plate and forward clamp member to the shopping cart causing it to be moved from right to left as viewed in FIGS. 1, 2, 3 and 6.

As a consequence, all of the shopping carts 40 which have been positioned on the conveyor assembly 80 in the manner described are transported in spaced relation to each other, as controlled by the spacing of the drive fingers 110 thereof, from right to left as viewed in FIG. 1 or, in other words, toward the cart receiving housing 145.

The shopping carts 40 are successively transported in the direction indicated until they reach the terminus 91 of the conveyor assembly 80. At this point, the drive fingers pass around the inner sprocket assembly 103 and, thereby release the roller 178 of the linking assembly 160 of the shopping cart 40. The shopping cart is propelled over the terminus 91 and into the entrance opening 150 of the cart receiving housing 145. The front wheel assemblies 44 and, thereafter, the rear wheel assemblies 45 contact and pass gravitationally downwardly on the sloped floor 146 of the cart receiving housing toward the vertical end wall 148. The proximity of the parallel side walls 147 on opposite sides thereof cause the shopping cart to continue in movement from right to left as viewed in FIG. 1. If there are no other shopping carts within the cart receiving housing 145, the shopping cart 40 simply travels gravitationally downwardly along the sloped floor until the front wall 63 of the basket assembly 60 thereof comes into contact with the end wall 148. At this point, the shopping cart comes to a stop and is available for reuse.

In the event other shopping carts 40 are housed within the cart receiving housing 145 at the time any given shopping cart 40 passes into the cart receiving housing, the engagement of the side walls 62 of the shopping cart with the side walls 62 of the next adjacent shopping cart directs the latter shopping cart to nest within the basket assembly of the preceding shopping cart, as can best be visualized in FIGS. 1 and 2. The rear wall 64, being pivotal, pivots upwardly to allow admission of the basket assembly of the trailing shopping cart into the basket assembly of the preceding shopping cart so as to permit such nesting to take place. The shopping carts so collected are thus available for reuse or for collection and movement to a secondary area for reuse. They can be removed from the collection area by any suitable means, not shown.

With reference to FIG. 2, the apparatuses 10 of the present invention shown therein are used in the identical fashion heretofore described except that two such conveyor assemblies 80 are employed.

In the case of the conveyor assembly 120 shown in FIG. 7, the operation is substantially the same except as hereinafter described. Each successive shopping cart 40 is directly moved to the conveyor assembly 120 from the parking stall 24 in which the vehicle 26 of the customer is parked after emptying of the shopping cart. The front wheel assemblies 44 of the shopping cart moved upwardly along the adjacent sloped side plate 122 of the conveyor housing 121 and the shopping cart is gradually turned into the direction illustrated in FIG. 7 in which the front and rear wheel assemblies 44 and 45 of the shopping cart are entirely supported on the platform 127 as shown in FIG. 7 with the front wall 63 of the shopping cart facing toward the cart receiving housing 145. When properly oriented, the pivot arm assembly 172 thereof gravitationally moves downwardly through the slot 125 of the conveyor housing 121 into the position shown in FIG. 7. This position is equivalent to the one shown in full lines in FIG. 6 except that the roller 178 thereof is beneath the slot 125, as shown in FIG. 7.

The next successive drive finger 134 of the conveyor assembly 120 then passes into engagement with the roller 178 thereof and transports the shopping cart along the platform 127 toward the cart receiving housing 145. Thereafter, operation of the conveyor assembly 120 is substantially identical to that heretofore described in relation to conveyor assembly 80.

The linking assemblies 160 borne by the shopping carts 40, as heretofore described, do not otherwise interfere with operation of the shopping carts. During movement through the shopping complex, the parking lot 20 and otherwise, the pivot arm assembly 172 is pivotal from the position shown in full lines in FIG. 6 to the position shown in phantom lines in FIG. 6. This ensures that if the roller 178 is drawn into contact with an obstruction of any sort, it is pivoted out of the way and over the obstruction with the roller 178 rolling over the obstruction so as to avoid any interference between the linking assembly and the obstruction.

Therefore, the apparatus for conveying work objects is uniquely well suited to the conveyance of shopping carts from outlying areas of parking lots adjacent to shopping complexes is so designed as to encourage the return of shopping carts to the central collection area; is entirely safe and dependable in operation; is inconspicuous so as not to detract from the overall aesthetic appearance of the shopping complex; can be installed in a variety of forms and in a variety of environments to achieve the return of the shopping carts; is inexpensive to install, maintain and operate and requires no personnel for operation thereof; and is otherwise entirely successful in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for conveying shopping carts moveable in a predetermined direction of travel, the apparatus comprising:

A. means for conveying shopping carts in a direction of travel to a release position and including a conveyor having a transporting run moveable in .said direction of travel and a housing enclosing said transporting run having an opening communicating with said transporting run, said shopping carts positionable in transport positions in juxtaposition to said opening;

B. means for receiving the shopping carts in a collection area adjacent to said release position of the conveying means; and C. assemblies for individually interconnecting said shopping carts and the conveyor operable individually to move the shopping carts in said direction of travel to the release position and to release said shopping carts in said release position for receipt in the collection area, said assemblies including a plurality of conveying members borne by the conveyor in spaced relation to each other for movement therewith in said direction of travel, said conveying members having an arcuate surface facing in said direction of travel and linking members individually borne by the shopping carts individually engageable by the conveying members for movement by the conveyor in said direction of travel, said linking members individually mounted on their respective shopping carts for pivotal movement in a direction opposite to said direction of travel so as to be pivotal from contact during movement in said direction of travel and positionable in linking positions extending through said opening for engagement by the conveying members of the transporting run of the conveyor for movement by the conveying members in said direction of travel and the linking members of the shopping carts having distal portions individually mounting substantially cylindrical members engageable by the conveying members for transport of the shopping carts in said direction of travel.

2. An apparatus for conveying shopping carts moveable in a predetermined direction of travel and wherein said shopping carts are borne by pivotal wheel assemblies spaced from each other transversely of the shopping carts, the apparatus comprising:

A. means for conveying shopping carts in a direction of travel to a release position and including a conveyor having a transporting run moveable in said direction of travel and a housing enclosing said transporting run having an opening communicating with said transporting run, said housing having shoulders sloped upwardly toward each other on opposite sides of said opening so as to define a guide path substantially aligned with said direction of travel whereby shopping carts can be moved into transport positions in juxtaposition to the opening straddling said guide path aligned with said direction of travel and guided therealong by said wheel assemblies of the shopping carts, being steered along the guide path by engagement of the wheel assemblies with said shoulders of the housing therebetween;

B. means for receiving the shopping carts in a collection area adjacent to said release position of the conveying means; and C. assemblies for individually interconnecting said shopping carts and the conveying means operable individually to move the shopping carts in said direction of travel to the release position and to release said shopping carts in said release position for receipt in the collection area, said assemblies including a plurality of conveying members borne by the conveyor in spaced relation to each other for movement therewith in said direction of travel, and linking members individually borne by the shopping carts individually engageable by the conveying members for movement by the conveyor in said direction of travel, said linking members individually mounted on their respective shopping carts for pivotal movement in a direction opposite to said direction of travel so as to be pivotal from contact during movement in said direction of travel and positionable in linking positions extending through said opening for engagement by the conveying members of the transporting run of the conveyor for movement by the conveying members in said direction of travel.

* * * * *

UNITED STATES PATENT AND TRADEMARK OFFICE

CERTIFICATE OF CORRECTION

PATENT NO. : 5,473,991

DATED : December 12, 1995

INVENTOR(S) : Martin D. Crum

It is certified that error appears in the above-identified patent and that said Letters Patent is hereby corrected as shown below:

Column 1, line 34, delete "requiting" and substitute

---requiring---.

Signed and Sealed this

Twenty-third Day of April, 1996

Bruce Lehman

*Attest:*

BRUCE LEHMAN

*Attesting Officer*

*Commissioner of Patents and Trademarks*